US009456684B1

(12) United States Patent
Frankel et al.

(10) Patent No.: US 9,456,684 B1
(45) Date of Patent: Oct. 4, 2016

(54) INTEGRATED FOLDING TABLE AND CHAIRS SET

(71) Applicant: Zenithen USA LLC, Diamond Bar, CA (US)

(72) Inventors: Andrew David Frankel, Yorba Linda, CA (US); Shi-Ping Zheng, Fuzhou (CN); Tian-Xia Zheng, Fujian (CN)

(73) Assignee: Zenithen USA, LLC, Diamond Bar, CA (US)

( * ) Notice: Subject to any disclaimer, the term of this patent is extended or adjusted under 35 U.S.C. 154(b) by 21 days.

(21) Appl. No.: 14/656,807

(22) Filed: Mar. 13, 2015

(51) Int. Cl.
*A47B 83/02* (2006.01)
*A47B 3/14* (2006.01)

(52) U.S. Cl.
CPC ..... *A47B 3/14* (2013.01); *A47B 83/02* (2013.01); *A47B 2003/145* (2013.01)

(58) Field of Classification Search
CPC ..... A47B 4/13; A47B 4/14; A47B 83/02; A47B 2003/145
USPC ..... 297/158.4, 159.1
See application file for complete search history.

(56) References Cited

U.S. PATENT DOCUMENTS 1,736,531 A * 11/1929 Hodinka ..... A47B 3/14 297/159.1
2,502,502 A * 4/1950 Bennett ..... A47B 3/14 297/156
5,683,135 A * 11/1997 Williams ..... A47B 3/14 108/118
6,010,186 A * 1/2000 Tsay ..... A47B 39/06 297/158.4
6,193,308 B1 * 2/2001 Hwang ..... A47B 3/14 297/171
7,011,364 B2 * 3/2006 Meskill ..... A47B 3/0912 108/127
7,226,125 B2 * 6/2007 Frobose ..... A47B 3/14 108/64
7,604,289 B2 * 10/2009 Chen ..... A47C 9/022 108/127
7,922,245 B1 * 4/2011 Sawhney ..... A47B 3/14 297/158.4
2008/0018142 A1 * 1/2008 Yul ..... A47B 3/14 297/158.4
2008/0178776 A1 * 7/2008 Arias ..... A47B 3/14 108/115
2008/0238158 A1 * 10/2008 Jiu ..... A47B 3/14 297/158.4
2009/0140557 A1 * 6/2009 Chen ..... A47C 9/022 297/142
2010/0301641 A1 * 12/2010 Rivera, Jr. ..... A47B 3/14 297/158.4
2013/0074743 A1 * 3/2013 Li ..... A47C 4/24 108/50.12
2015/0084383 A1 * 3/2015 Zhu ..... A47B 3/14 297/139

* cited by examiner

*Primary Examiner* — Timothy J Brindley
(74) *Attorney, Agent, or Firm* — Merek, Blackmon & Voorhees, LLC

(57) ABSTRACT

The present invention teaches an integrated folding table and chairs set, comprising a table and two chairs. The table comprises cross hinged table legs on both sides and a table top. The chair comprises the same or symmetrical supporting legs on both sides, a cushion and a back cushion. The supporting leg comprises mutually crossing front supporting rods and rear supporting rods. The front supporting rod extends upward from the cushion to form back cushion segments. A back cushion is installed on either back cushion segment, and the cushion is fixed to the front supporting rod and rear supporting rod; wherein, the table legs respectively comprise two cross hinged U-shaped rods. The top cross rod of the two U-shaped rods is used to fix and support the table top.

11 Claims, 5 Drawing Sheets

INTEGRATED FOLDING TABLE AND CHAIRS SET

TECHNOLOGY FIELD

The present invention relates to the field of daily necessities, especially relates to an integrated folding table and chairs set, especially wherein the table and chairs are subject to linked unfolding and folding operation.

BACKGROUND ART

The Chinese patent CN2870585Y shows an integrated folding table and chairs set, which is composed of two pieces of table tops linked together via a profiled hinge, wherein the table top is supported by a single table leg, the lower end of the inclined supporting rod of the table leg is fixed to the table leg by a rivet, the upper end of the inclined supporting rod of the chair leg is connected with the table top, the lower end of the inclined supporting rod of the chair leg touches the ground, and a chair top is provided on the inclined supporting rod of the chair leg. The device is subject to integrated folding, and can be quickly unfolded and folded. The unfolded device is stretching, while the folded table and chairs are incorporated into a small volume with light weight, and are put into a portable outer bag, which is very convenient for carrying. The table top is supported by the inclined supporting rod of a pair of chair legs, so that users can be seated thereon without the need of striding over the inclined supporting rod. Moreover, the chair is equipped with requiring a supporting backrest, and is only applicable to short break.

Therefore, some practitioners have designed integrated table and chairs with backrests. For example, CN20341243U discloses a new folding table with an umbrella, including two rows of opposite folding table and chairs, an umbrella tent support erecting upward is respectively provided between corresponding end parts of two rows of folding table and chairs, two lower ends of the umbrella tent support are respectively connected with the folding table and chairs on both sides, an umbrella tent is provided between two umbrella tent supports, and a fastener pin is provided on the umbrella tent. The umbrella tent is composed of two halves which are connected by top to top via negative and positive interfaces. The fastener pin is a two-piece pin that can be folded in the middle. Especially, the umbrella above and the table and chairs below are integrated, are the combination of a set of unfolded umbrella, table and chairs, and are folded up like a folded camp bed, which is compact, stocky, and not only practical and beautiful, but also easy to move. The Patent provides chairs with backrest, but the table and chairs are only connected with poor linkage in unfolding and folding operation, which also affects the use effect.

In the light of the defects of the prior art, how to provide a table and chairs set that is convenient for seating, is equipped with backrest and has good folding and unfolding consistency becomes the research object of the present application.

SUMMARY OF THE INVENTION

The present invention aims to provide an integrated table and chairs set that can realize the synchronous unfolding and folding the table and chairs, and is a four-bar linkage support structure composed of the local part of the front supporting rods and rear supporting rods on one side of the chairs and local parts of two cross table legs on one side of the table; and secondly aims to provide a rigid table top composed of two pieces of core boards wrapped with soft fabric.

The technical scheme of the present invention is realized at least in part as follows: An integrated folding table and chairs set, comprising a table and two chairs with folding function. The table includes cross hinged legs on both sides and a table top; the chair includes the same or symmetrical supporting legs on both sides. A cushion and a back cushion. The supporting legs include mutually crossed front and rear supporting rods, the front supporting rods extend above the cushion to form the backrest segments. A back cushion is installed on either backrest segments. A cushion is fixed to the front supporting rods and rear supporting rods; wherein: the table legs respectively comprise two cross hinged U-shaped rods, the top cross rod of the two U-shaped rods is used to fix and support the table top, at least two U-shaped rods on one side of the table legs have an extension segment downward from the cross hinge points, and the extension segments are respectively hinged in the lower parts of the front supporting rods on the same side of the two chairs. The rear supporting rods on that side of the two chairs extend upward are hinged on the other U-shaped rod above the cross hinge point, and form a four-bar linkage support structure with the help of the local part of two U-shaped rods at the same side. A local part of the front supporting rods and rear supporting rods of the chairs.

The table top is a rigid folding structure, the middle part of which is hinged by a hinge structure. Both end parts of the table top are respectively fixed to the top cross rod of the U-shaped rod. When both U-shaped rods are folded, the table top can be folded along the hinge. A supporting cross rod is provided under the table top. There is a bent segment at either end of the supporting cross rod, and the end part of the bent segment is respectively hinged above the cross hinge point of one U-shaped rod. A supporting rod is hinged at the extension segment below the cross hinge point of the other U-shaped rod, the other end of the supporting rod is hinged at the bent segment of the supporting cross rod. The supporting cross rod collides with the bottom of the hinge joint part of the table top or the bottom of the table top near the hinge joint part.

A fastening belt is provided at the bottom of the table top. The fastening belt is sleeved on the supporting cross rod. During folding, the supporting cross rod moves downward, so as to drive the table top to fold downward.

The table top is composed of the core board. The outside of the core board is wrapped with flexible waterproof fabric, which forms an edge by sewing or bonding around. There is a gap edge in adjacent part of the two core boards forming a folding hinge structure. The edge at either end of the table top is winded with a steel sheet and then fixed to the top cross rod of the U-shaped rod.

The table top is a rigid entirety. The bottom at one end of the table top is moveably sleeved on the top cross rod of a U-shaped rod through a moveable sleeve. An elastic buckle is provided at the bottom of the other end, and the table top is fixed to the top cross rod of the other U-shaped rod with the aid of the buckle.

There is a bent cross rod in the end part of the extension segment of the U-shaped rod. The end part of the bent cross rod is hinged on the front supporting rod on the other side of the chair.

The cushion is installed on the cushion rod. The fore part of the cushion rod is moveably hinged in the upper end of the rear supporting rod, and the rear part of the cushion rod is moveably hinged in the middle part of the front supporting rod. The mutual crossing of the front supporting rod and rear supporting rod means that the front supporting rod is hinged with a sliding sleeve. The rear supporting rod runs through the sliding sleeve, and a stop block is fixed above the crossing of the rear supporting rod. When the chair is unfolded in place, the sliding sleeve collides with the stop block forming the moveable cross structure and stress support.

The cushion rod is composed of two parallel rods, which are respectively moveably hinged between the upper end of the rear supporting rod and middle part of the front supporting rod. The front supporting rod on either side is bent by a rod into a front U-shaped frame. The front cross rod of the front U-shaped frame is at one end of the backrest segment. The rear supporting rod is bent by a rod into a rear U-shaped frame. The rear cross rod of the rear U-shaped frame touches the ground, and a first cross rod is also hinged between the rear supporting rods on both sides. The first cross rod, the front cross rod and the rear cross rod form a rigid link structure of the supporting legs on both sides. The cushion and back cushion are made of flexible material and are respectively fastened on the cushion rod and the backrest segment of the front supporting rod.

A second cross rod is hinged between the two sliding sleeves.

The present invention is characterized by wise conception, good linkage, stable support, smooth operation, and easy use. Local parts on one side of the folding table and local parts on one side of the folding chair form a four-bar linkage mechanism, which not only plays a role in supporting the table top, but also can realize linked operation of synchronous unfolding and folding. One side of the table top is impending to facilitate legs and feet to get in and out; the folded assembly shows a flat structure, and occupies less space.

BRIEF DESCRIPTION OF THE DRAWINGS

The present invention is further illustrated in the light of specific drawings below.

Figure 1:
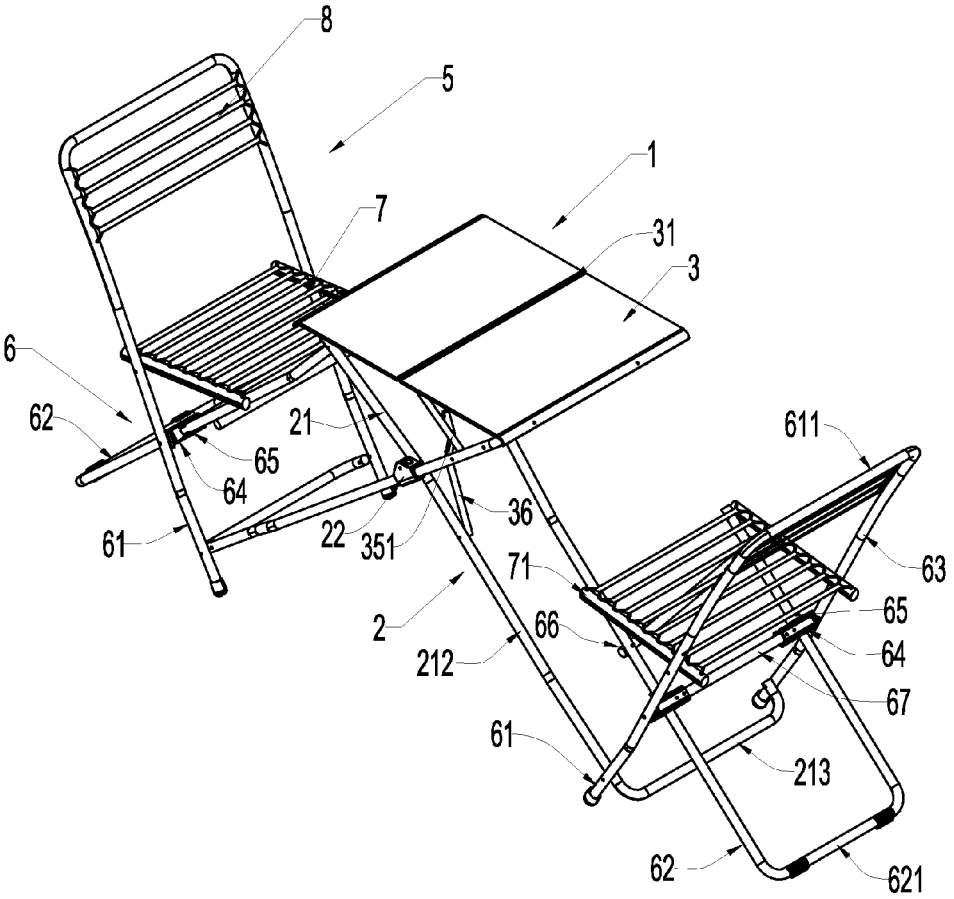
FIG. 1 is a three-dimensional diagram of an integrated table and chairs set

| | | |
|---|---|---|
| 1-Table | 2-Table leg | 21-U-shaped rod |
| 211-Top cross rod | 212-Extension segment | 213-Bent cross rod |
| 22-Cross hinge point | 3-Table top | 31-Hinge structure |
| 32-Core board | 33-Flexible fabric | 331-Edge |
| 34-Steel sheet | 35-Supporting cross rod | 351-Bent segment |
| 36-Supporting rod | 37-Fastening belt | 38-Moveable sleeve |
| 39-Elastic buckle | 5-Chair | 6-Supporting leg |
| 61-Front supporting rod | 611-Front cross rod | 62-Rear supporting rod |
| 621-Rear cross rod | 63-Backrest segment | 64-Sliding sleeve |
| 65-Stop block | 66-First cross rod | 67-Second cross rod |
| 7-Cushion | 71-Cushion rod | 8-Back cushion |

DETAILED DESCRIPTION OF THE INVENTION

Example I

According to FIG. 1 to FIG. 6, an integrated folding table and chairs set comprises a table 1 and two chairs 5 with folding function.

The chair 5 comprises the same or symmetrical supporting legs 6 on both sides, a cushion 7 and a back cushion 8. The supporting leg 6 comprises mutually crossing front supporting rods 61 and rear supporting rods 62. The front supporting rod 61 extends upward from the cushion to form a back cushion segment 63. A back cushion 8 is installed on either back cushion segment 63. The cushion 7 is fixed to the front supporting rod 61 and rear supporting rod 62 to form such a structure that the front supporting rods 61 and rear supporting rods 62 can be folded together.

The preferable folding chair structure in this example is as follows: The cushion 7 is installed on the cushion rod 71. The fore part of the cushion rod 71 is moveably hinged in the upper end of the rear supporting rod 62. The rear part of the cushion rod is moveably hinged in the middle part of the front supporting rod 61. The mutual crossing of the front supporting rod 61 and rear supporting rod 62 means that the front supporting rod 61 is hinged with a sliding sleeve 64. The rear supporting rod 62 runs through the sliding sleeve 64. A stop block 65 is fixed above the crossing of the rear supporting rod 62. When the chair is unfolded in place, the sliding sleeve 64 collides with the stop block 65 forming the moveable cross structure and stress support. A second cross rod 67 is hinged between two sliding sleeves 64, which can not only strengthen the transverse stress at the crossing of the front supporting rod 61 and rear supporting rod 62 and improve the stability of the chair, but can also ensure smooth folding operation.

Furthermore, the cushion rod 71 is composed of two parallel rods, which are respectively moveably hinged between the upper end of the rear supporting rod 62 and middle part of the front supporting rod 61. The cushion rod 71 comprising two parallel rods can keep the space for the cushion 7 to move downward due to gravity, so as to avoid the cushion rod to locally support the user's legs thereunder, which will cause adverse experience. The front supporting rod 61 on either side is bent by a rod into a front U-shaped frame. The front cross rod 611 of the front U-shaped frame is at one end of the backrest segment 63, which can not only improve the strength of the backrest segment 63, but also provide a handle for folding operation or carrying. The rear supporting rod 62 is bent by a rod into a rear U-shaped frame. The rear cross rod 621 of the rear U-shaped frame touches the ground, and a first cross rod 66 is also hinged between the rear supporting rods 62 on both sides. The first cross rod 66 is arranged at the opening of the rear U-shaped frame so as to avoid inward contraction of the rear supporting rods 62 on both sides after the cushion rod 71 is stressed. The first cross rod 66, the front cross rod 611 and the rear cross rod 621 of the supporting legs 6 on both sides of the chair 5 form a rigid link structure to provide a bearing structure. In addition, the cushion 7 and back cushion 8 are made of not only the conventional prefabricated sheet material and sponge, but also of a flexible material, such as Oxford cloth and elastic belt, preferred in this example. Both sides are respectively fastened on the cushion rod 71 and the backrest segment 63 of the front supporting rod 61, so that it is not only portable and foldable, but also occupies little space, and is especially suitable for outdoor use.

Table 1 includes cross hinged table legs 2 on both sides and a table top 3. The table legs 2 respectively include two cross hinged U-shaped rods 21. The top cross rod 211 of two U-shaped rods 21 is used to fix and support the table top 3. At least two U-shaped rods 21 on one side of the table legs have an extension segment 212 downward from the cross hinge point 22. The extension segment 212 is respectively hinged in the lower part of the front supporting rods 61 on the same side of the two chairs 5. The rear supporting rod 62 on that side of the two chairs 5 extends upward, is hinged on the other U-shaped rod 21 above the cross hinge point 22, and forms a four-bar linkage support structure with the help of the local part of two U-shaped rods 21 at the same side, and local part of the front supporting rods 61 and rear supporting rods 62 of the chair. Furthermore, the extension segment 212 of the U-shaped rod 21 comprises a bent cross rod 213. The end part of the bent cross rod 213 is hinged on the front supporting rods 61 on the other side of the chair 5. The bent cross rod 213 helps to form a linkage with the front supporting rods 61 on both sides of the chair, which not only improves the strength of the lower part of the bent U-shaped frame of the front supporting rods 61, but also plays a role in stably supporting the table 1 impending on one side, and avoids deflection towards the impending side, as shown in FIG. 2.

Figure 5:
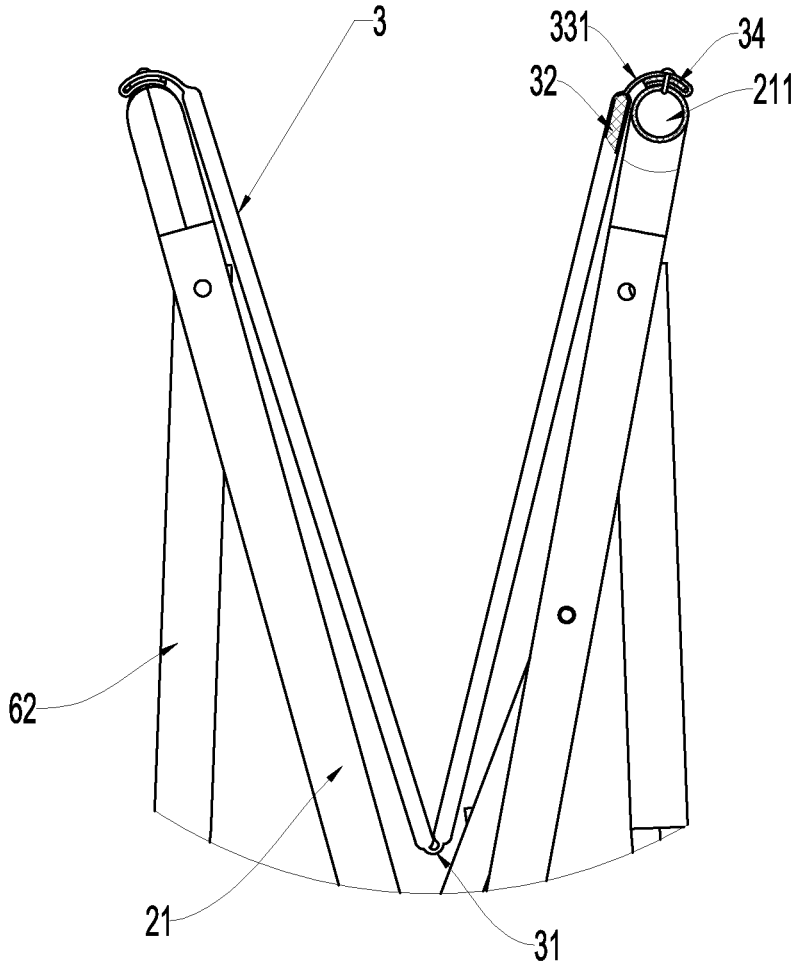
FIG. 5 is a local section view of the relation between the table top and table legs
Figure 6:
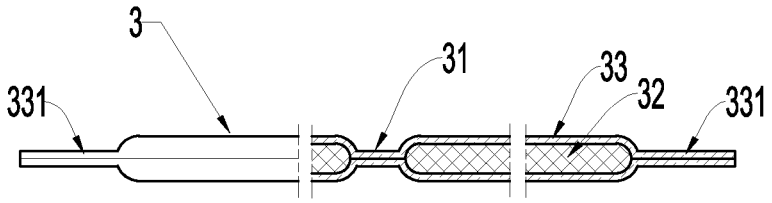
FIG. 6 is a local section view of the folded table top

The table top 3 is a rigid folding structure, the middle part of which is hinged by a hinge structure 31. Both end parts of the table top 3 are respectively fixed to the top cross rod 211 of the U-shaped rod 21. When both U-shaped rods 21 are folded, the table top 3 can be folded along the hinge. More specifically, the table top 3 is composed of the core board 32 and flexible waterproof fabric 33, the outside of the core board 32 is wrapped with the flexible fabric 33, which forms an edge 331 by sewing or bonding around. There is a gap edge in adjacent part of the two core boards 32, and the gap edge forms a folding hinge structure 31; the edge 331 at either end of the table top 3 is winded with a steel sheet 34, and then fixed to the top cross rod 211 of the U-shaped rod 21, as shown in FIG. 5 and FIG. 6.

Figure 2:
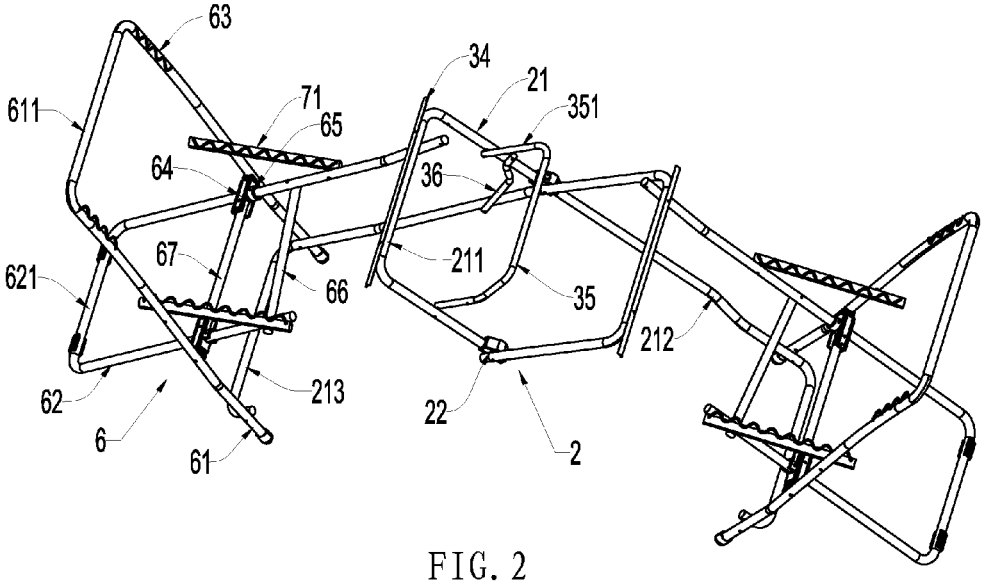
FIG. 2 is a schematic diagram of the support of an integrated table and chairs set
Figure 3:
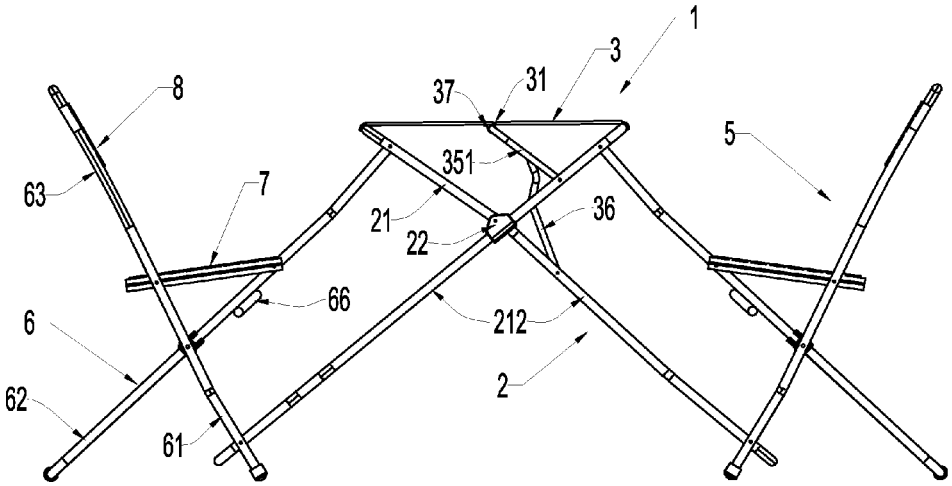
FIG. 3 is a side view of an integrated table and chairs set
Figure 4:
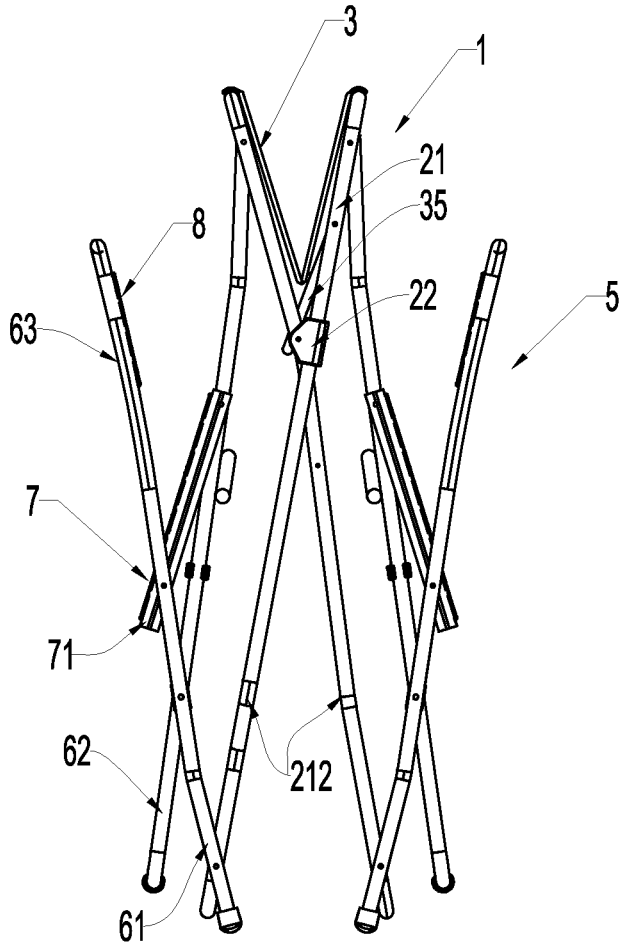
FIG. 4 is a schematic diagram of folding of an integrated table and chairs set

Therefore, it is necessary to design a supporting cross rod 35 under the table top 3, as shown in FIG. 2 and FIG. 3. There is a bent segment 351 at either end of the supporting cross rod 35, and the bent segment is bent by a rod into a U-shaped structure. The end part of the bent segment 351 is respectively hinged above the cross hinge point 22 of one of the U-shaped rods 21. A supporting rod 36 is hinged at the extension segment 212 below the cross hinge point 22 of the other U-shaped rod 21. The other end of the supporting rod 36 is hinged at the bent segment 351 of the supporting cross rod 35. The supporting cross rod 35 collides with the bottom of the hinge joint part of the table top 3 or the bottom of the table top 3 near the hinge joint part, and plays a role in supporting the middle part of the folding table top 3. As shown in FIG. 3, furthermore, a fastening belt 37 is provided at the bottom of the table top 3, and the fastening belt 37 is sleeved on the supporting cross rod 35. During folding, the supporting cross rod 35 moves downward, so as to drive the table top 3 to fold downward.

Example II

Figure 7:
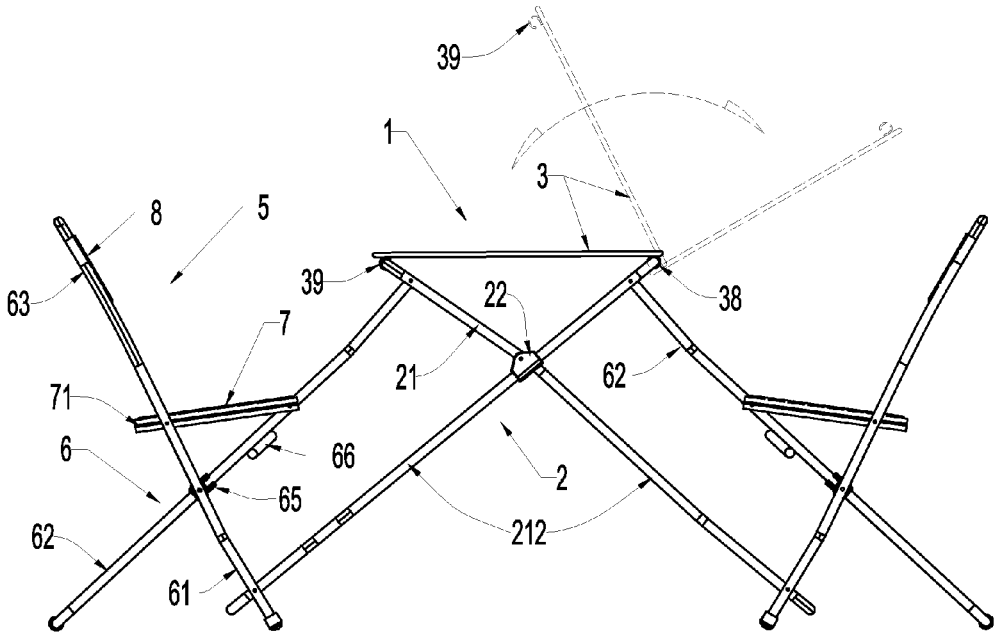
FIG. 7 is a schematic diagram of the whole table top of an integrated table and chairs set Wherein the enumerated parts of at least one aspect of the invention include.

According to FIG. 7, the table top 3 in this example is a rigid entity, namely a whole sheet material. The bottom at one end of the table top is moveably sleeved on the top cross rod 211 of a U-shaped rod 21 through a moveable sleeve 38. An elastic buckle 39 is provided at the bottom of the other end. The table top 3 is fixed to the top cross rod 211 of the other U-shaped rod with the aid of the buckle 39. In this structure, there is no need for additional support. But when the integrated table and chairs are unfolded or folded, it is necessary to add an operation, as shown by the dotted line in the figure, that is, only by turning up the table top 3, can the table top be kept flat for use or folding.

In conclusion, integrated table and chairs are provided in the preferred examples. The table top is an impending structure, which helps to keep the space on one side for users' legs and feet to get in and out and for activity space, and to get the best experience. Alternatively, all U-shaped rods 21 on both sides of the table legs 2 extend downward from the cross hinge point 22, form extension segments 212, are hinged in the lower part of the front supporting rod 61 on the same side of the chair 5, and form a stable four-leg support of the table top 3. This structure also falls within the teaching of this application. The scheme of an integrated table 1 and chairs 5 in the present invention is applicable to forming integrated table and chairs set with linked unfolding and folding structure on the existing chair with X cross on any two sides, and is not limited to the chair scheme in this example.

We claim:

1. An integrated folding table and chairs set, comprising a table (1) and two chairs (5) with folding function; wherein, the table (1) comprises cross hinged table legs (2) on both sides and a table top (3); the chair (5) comprises symmetrical supporting legs (6) on both sides, a cushion (7) and a back cushion (8); each supporting leg (6) comprises mutually crossing front supporting rods (61) and rear supporting rods (62), the front supporting rod (61) extends upward from the cushion (7) to form back cushion segments, a back cushion is installed on either back cushion segment (63), and the cushion (7) is fixed to the front supporting rod (61) and rear supporting rod (62); wherein: the table legs (2) respectively comprise two cross hinged U-shaped rods (21), a top cross rod (211) of the two U-shaped rods (21) is used to fix and support the table top (3), the two U-shaped rods (21) have, on one side of the table legs, (2) extension segments (212) extending downward from the cross hinge points (22), and the extension segments (212) are respectively hinged in the lower parts of the front supporting rods (61) on the same side of the two chairs (5); the rear supporting rods (62) on the one side of two chairs (5) extend upward, are hinged on the other U-shaped rod (21) above the cross hinge point (22), and form a four-bar linkage support structure with the two U-shaped rods at the same side, and the front supporting rods (61) and rear supporting rods (62) of the chair (5).

2. An integrated folding table and chairs set according to claim 1, wherein, the table top (3) is a rigid folding structure, the middle part of which is hinged by a hinge structure (31); end parts of the table top (3) are respectively fixed to the top cross rod (211) of the U-shaped rod (21) such that when both U-shaped rods (21) are folded, the table top (3) can be folded along the hinge; a supporting cross rod (35) is provided under the table top (3); wherein a bent segment is located at either end of the supporting cross rod (35); the end part of the bent segment (351) is respectively hinged above the cross hinge point (22) of one of the U-shaped rods (21); a supporting rod (36) is hinged at the extension segment (212) below the cross hinge point (22) of the other U-shaped rod (21), the other end of the supporting rod (36) is hinged at the bent segment (351) of the supporting cross rod (35); the supporting cross rod (35) is connected with the bottom of the hinge joint part of the table top (3) or the bottom of the table top (3) near the hinge joint part.

3. An integrated folding table and chairs set according to claim 2, wherein, a fastening belt (37) is provided at a bottom of the table top (3), and the fastening belt (37) is sleeved on the supporting cross rod (35) such that during folding, the supporting cross rod (35) moves downward, so as to drive the table top (3) to fold downward.

4. An integrated folding table and chairs set according to claim 3, wherein, the table top (3) is composed of the core board (32) and flexible waterproof fabric (33), the outside of the core board (32) is wrapped with the flexible fabric (33), which forms an edge (331) by sewing or bonding around; there is a gap edge in adjacent part of the two core boards (32), forming a folding hinge structure (31); the edge (331) at either end of the table top (3) is winded with a steel sheet (34), and then fixed to the top cross rod (211) of the U-shaped rod (21).

5. An integrated folding table and chairs set according to claim 2, wherein, the table top (3) is composed of the core board (32) and flexible waterproof fabric (33), the outside of the core board (32) is wrapped with the flexible fabric (33), which forms an edge (331) by sewing or bonding around; there is a gap edge in adjacent part of the two core boards (32), forming a folding hinge structure (31); the edge (331) at either end of the table top (3) is winded with a steel sheet (34), and then fixed to the top cross rod (211) of the U-shaped rod (21).

6. An integrated folding table and chairs set according to claim 1, wherein, the table top (3) is composed of the core board (32) and flexible waterproof fabric (33), the outside of the core board (32) is wrapped with the flexible fabric (33), which forms an edge (331) by sewing or bonding around; there is a gap edge in adjacent part of the two core boards (32), forming a folding hinge structure (31); the edge (331) at either end of the table top (3) is winded with a steel sheet (34), and then fixed to the top cross rod (211) of the U-shaped rod (21).

7. An integrated folding table and chairs set according to claim 1, wherein, the table top (3) is a rigid entirety; a bottom at one end of the table top is moveably sleeved on the top cross rod (211) of a U-shaped rod (21) through a moveable sleeve (38), an elastic buckle (39) is provided at a bottom of the other end, and the table top (3) is fixed to the top cross rod (211) of the other U-shaped rod (21) with the aid of the buckle (39).

8. An integrated folding table and chairs set according to claim 1, wherein, the extension segment (212) of the U-shaped rod (21) comprises a bent cross rod (213), an end part of the bent cross rod (213) is hinged on the front supporting rods (61) on the other side of the chair (5).

9. An integrated folding table and chairs set according to claim 1, wherein, the cushion (7) is installed on a cushion rod (71), a fore part of the cushion rod (71) is moveably hinged in an upper end of the rear supporting rod (62), and a rear part of the cushion rod is moveably hinged in a middle part of the front supporting rod (61); the mutual crossing of the front supporting rod (61) and rear supporting rod (62) allows for the front supporting rod (61) to be hinged with a sliding sleeve (64), the rear supporting rod (62) runs through the sliding sleeve (64), and a stop block (65) is fixed above the crossing of the rear supporting rod (62); when the chair (5) is unfolded in place, the sliding sleeve (64) collides with the stop block (65), forming the moveable cross structure and stress support.

10. An integrated folding table and chairs set according to claim 1, further comprising a cushion rod (71) composed of two parallel rods, which are respectively moveably hinged between an upper end of the rear supporting rod (62) and a middle part of the front supporting rod (61); the front supporting rod (61) on either side is bent by a rod into a front U-shaped frame, a front cross rod (611) of the front U-shaped frame is at one end of the backrest segment (63); the rear supporting rod (62) is bent by a rod into a rear U-shaped frame, a rear cross rod (621) of the rear U-shaped frame touches the ground, and a first cross rod (66) is also hinged between the rear supporting rods (62) on both sides; the first cross rod (66), the front cross rod (611) and the rear cross rod (621) form a rigid link structure of the supporting legs (6) on both sides; the cushion (7) and back cushion (8) are made of flexible material, and are respectively fastened on the cushion rod (71) and the backrest segment (63) of the front supporting rod (61).

11. An integrated folding table and chairs set according to claim 7, wherein, a second cross rod (67) is hinged between two sliding sleeves (64).

* * * * *